United States Patent [19]

Everett

[11] Patent Number: 4,527,604

[45] Date of Patent: Jul. 9, 1985

[54] WOOD CHIPPING ASSEMBLY

[76] Inventor: Colvin K. Everett, 701 Terral Island Rd., Farmerville, La. 71241

[21] Appl. No.: 581,584

[22] Filed: Feb. 21, 1984

[51] Int. Cl.[3] ..... B02C 16/08

[52] U.S. Cl. ..... 144/176; 241/92; 144/252 A

[58] Field of Search ..... 144/176, 162 R, 252 A; 241/92

[56] References Cited

U.S. PATENT DOCUMENTS

| | | | |
|---|---|---|---|
| 3,346,027 | 10/1967 | Kirsten | 144/176 |
| 3,866,843 | 2/1975 | Lunn | 241/92 |
| 3,905,558 | 9/1975 | Gaitten | 241/92 |
| 4,247,053 | 1/1981 | Lapointe | 241/92 |

FOREIGN PATENT DOCUMENTS

| | | | |
|---|---|---|---|
| 1071066 | 2/1980 | Canada | 144/176 |
| 2714698 | 11/1977 | Fed. Rep. of Germany | 144/176 |

*Primary Examiner*—W. D. Bray

*Attorney, Agent, or Firm*—C. A. Phillips; Michael L. Hoelter

[57] ABSTRACT

A wood chipping assembly having a discharge chute that includes a directional flap such that, depending upon the position of the flap, the wood chips and the residual material generated by the wood chipping assembly may be commingled or they may be maintained in separate chutes so as to be individually discharged. This directional flap is maintained in its desired position by a latching mechanism.

3 Claims, 8 Drawing Figures

WOOD CHIPPING ASSEMBLY

FIELD OF THE INVENTION

This invention relates generally to wood chipping, and particularly to a new apparatus for discharging wood chips from a wood chipper.

BACKGROUND ART

There exists a variety of wood chipping assemblies which transform a whole tree into wood chips. Besides wood chips, these assemblies also generate residual matter, such as bark chips, knots and sawdust, which is generally kept separate from the good wood chips. In some cases, this separation is desirable such as when the chips are to be converted into pulp or paper. In other cases, however, the commingling of good chips and this residual material is desirable such as when the combination is to be burned as fuel. Thus, it sometimes becomes desirable to generate wood chips and residual matter separately and other times to commingle the two, depending upon the end use.

As far as is known, the majority of wood chipping assemblies generate wood chips and residual material separatedly from each other with the remaining chipping assemblies commingling the wood chips and residual material together. None of these assemblies, it is believed, enables a user to switch from one method of generation to another as may be desired. Thus, to obtain both mixtures of wood chips, two separate wood chipping assemblies are required, which is expensive and inefficient. Additionally, when such wood chipping is accomplished in the field or forest as compared to a wood yard of a paper mill, each assembly must be separately maneuvered to the job site, which is time-consuming and expensive.

It is a purpose of this invention to enable either mixture of wood chips to be generated as desired from only a single wood chipping assembly. It is a further purpose of this invention to enable rapid switching from one type of wood chip mixture to another.

SUMMARY OF THE INVENTION

In accordance with this invention, a wood chipping assembly comprises rotatable cutting blades that reduce a tree to either wood chips or residual matter. These blades are enclosed within a housing that contains an inlet opening through which the tree trunk passes and first and second discharge openings through which wood chips and residual matter, respectively, pass. First and second chutes surround and attach to each exit opening, and between these chutes is positioned a pivotal directional flap that either maintains the separation of this material or commingles it, depending upon the position the flap is latched in.

DETAILED DESCRIPTION OF THE DRAWINGS

Figure 2:
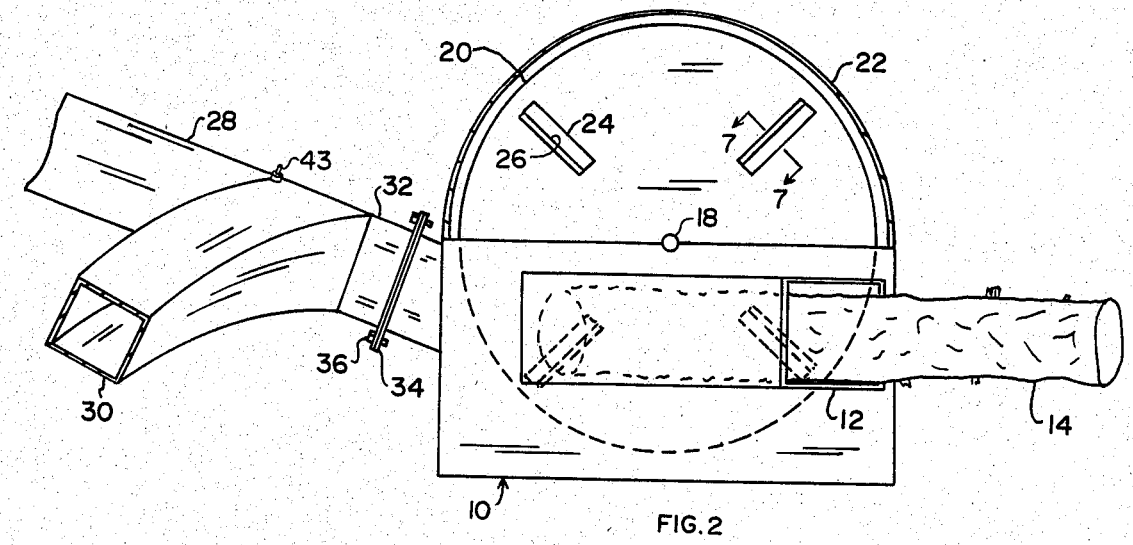
FIG. 2 is a diagrammatic side view, partially cut away, of the wood chipping assembly illustrated in FIG. 1.
Figure 1:
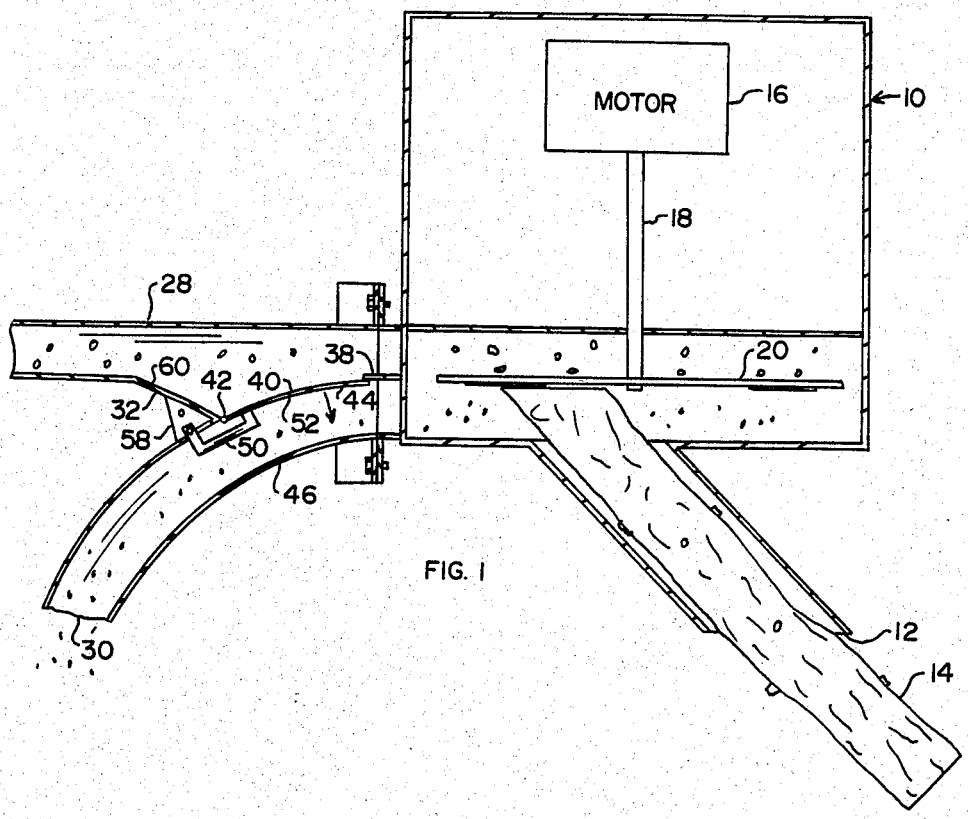
FIG. 1 is a diagrammatic plan view, partially cut away, of a wood chipping assembly.
Figure 7:
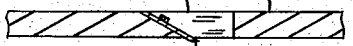
FIG. 7 is a sectional view taken along line 7—7 of FIG. 2.

Referring initially to FIGS. 1 and 2, there is shown a conventional wood chipping device 10 having an inlet opening 12 through which whole tree 14 is inserted to be chipped. Motor 16 connected to shaft 18 rotates circular chipping blade 20 within blade housing 22 of wood chipper 10. Chipping blade 20 is conventionally designed having a series of spaced openings 24 therein with one edge of each opening configured in the shape of a sharp tapered knife 26 (FIG. 7) which, when blade 20 is rotated, engage and slice chips from whole tree 14. Good chips, which are sliced from tree 14, pass through these openings and are discharged out good chip chute 28. Bark and other debris which does not pass through openings 24 are discharged out of chipper 10 via debris chute 30. Both good chips and debris are pneumatically blown out their respective chutes via the rotation of chipping blade 20. Together good chip chute 28 and debris chute 30 form discharge chute 32.

Figure 5:
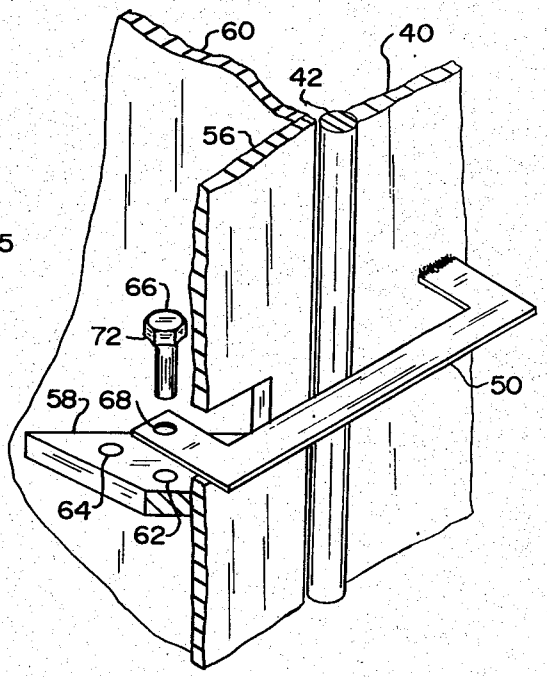
FIG. 5 is an isometric view, partially cut away, of a portion of the discharge chute showing the operation of the directional flap.
Figure 8:
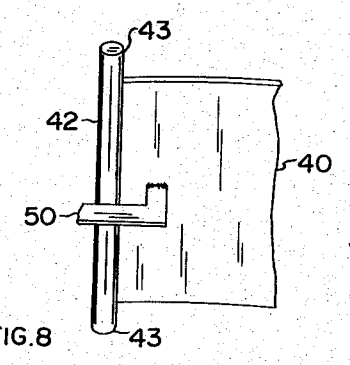
FIG. 8 is a diagrammatic view, partially cut away, of the flap.
Figure 6:
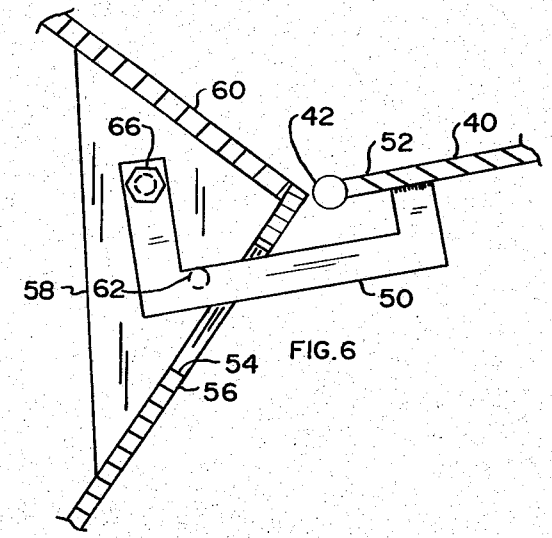
FIG. 6 is a diagrammatic plan view, partially cut away, of the latching mechanism when fastened in a second position.
Figure 3:
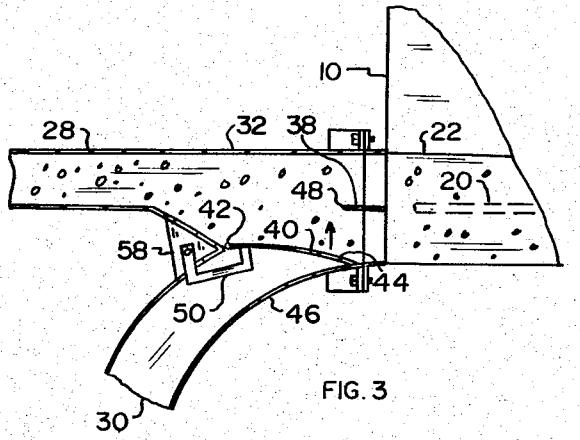
FIG. 3 is a diagrammatic plan view of a portion of the discharge chute of the wood chipping assembly illustrated in FIG. 1.
Figure 4:
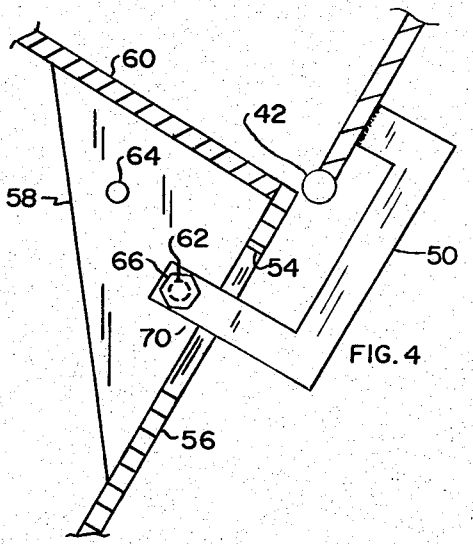
FIG. 4 is a diagrammatic plan view, partially cut away, of the latching mechanism when fastened in one position.

Discharge chute 32 is bolted to wood chipper 10 via flange 34 and bolts 36. A separator plate 38 positioned in the same plane as circular chipping blade 20 maintains the separation of good chips from debris prior to their entry into discharge chute 32. A directional flap or gate 40 is pivotally supported within discharge chute 32 via hinge 42. End regions 43 (FIG. 8) of hinge 42 extends through openings in discharge chute 32 to enable the pivoting of attached gate 40. Gate 40 is limited in its rotation around hinge 42 such that end 44 of gate 40 is only maneuverable along an arc between separator plate 38 and outer wall 46 of debris chute 30. This is due to end 44 of gate 40 extending radially outward from hinge 42 a greater distanct than is end 48 of separator plate 38 spaced from hinge 42. Thus, gate 40 swings between engagement with separator plate 38 and outer wall 46 (FIGS. 1 and 3). A bent arm 50 welded to end 52 of gate 40 extends through opening 54 in opposite wall 56 of debris chute 30 (FIGS. 4–6). A gusset plate 58 generally in the shape of a triangle is welded between wall 56 of debris chute 30 and outer wall 60 of good chip chute 28. Gusset plate 58 is positioned adjacent to the bottom edge of opening 54 in debris chute 30 and contains two openings 62 and 64 therein sized to accommodate a metal pin 66. A similarly sized opening 68 is located in end 70 of arm 50 such that when arm 50 is placed in one position, opening 68 in arm 50 and opening 62 in gusset plate 58 coincide (FIG. 4), and when gate 40 is placed in a second, different, position, opening 68 and the other opening 64 in gusset plate 58 coincide (FIG. 6). Pin 66 is inserted through opening 68 in arm 50 and through either of openings 62 and 64 to prevent further movement of gate 40 about hinge 42, thereby locking gate 40 in its desired position (FIG. 5). Pin 66 contains an enlarged head 72 sized greater than opening 68 in end 70 of arm 50 such that head 72 rests on arm 50 and is unable to slide through opening 68.

Under normal conditions when it is desired to maintain the separation of good chips from debris, directional gate 40 is pivoted so that end 44 is in engagement with separator plate 38 (FIG. 1). Pin 66 is then positioned through opening 68 and opening 62 of gusset plate 58 to lock gate 40 in place (FIG. 4). As chipping blade 20 rotates, good chips are discharged out good chip chute 28 of discharge chute 32 while debris is discharged out debris chute 30 of discharge chute 32 as shown in FIG. 1. However, should it be desired to combine debris with good chips, pin 66 is removed from openings 68 and 62, and gate 40 is pivoted about hinge 42 such that opening 68 in arm 50 coincides with opening 64 in gusset plate 58 (FIG. 6). Pin 66 is then inserted through both openings 68 and 64 to lock gate 40 in place such that end of gate 40 engages outer wall 46 of debris chute 30 as shown in FIG. 3. The pneumatic discharge of both debris and good chips are then combined and exit wood chipper 10 via good chip chute 28.

I claim:

1. A wood chipping machine comprising:

a housing;

chipping means, positioned within said housing, including a rotatable shaft and cutting blades attached to and rotating about said shaft, for the reduction of a tree trunk into wood chips and residual matter;

an inlet opening in said housing and positioned to enable a tree trunk to be fed into said housing and engage said blades from a first side of said blades;

a first discharge outlet opening in said housing, adjacent to a first region of said housing being on the same side of said blades as said inlet opening, through which residual matter portions of a tree trunk other than wood chips is discharged;

a second discharge outlet adjacent to a second region of said housing, said second region of said housing being on an opposite side of said blades from said first region and wood chips cut by said blades being passed through said blade and discharged through said second discharge outlet;

a first chute extending from said first discharge outlet, and a second chute extending from said second discharge outlet;

a pivotally mounted plate between said chutes, movable to form, in a first position, a common wall of said first and second chutes, whereby wood chips are discharged through said second discharge outlet, and residual matter is discharged through said first discharge outlet, and said plate being movable to a second position which blocks said first chute and connects said first discharge outlet with said second chute, whereby wood chips and residual matter are both discharged through said second chute; and latching means secured to said plate for selectively securing said plate in either said first or second positions.

2. A wood chipping machine as set forth in claim 1 wherein said latching means comprises:

a second plate, said second plate being rigidly and exteriorly attached between said first and second chutes;

an arm extending from said first-named plate through said first chute and outward of said first chute to a position adjacent to said second plate;

first and second spaced openings in said second plate and an opening in said arm adjacent to said second plate; and a removable pin insertable through said opening in said arm and alternately through said first and second openings in said second plate, whereby, depending upon the insertion of said pin into one or the other of the openings in said second plate, said first-named plate is latched into one or the other of said positions.

3. A wood chipping machine as set forth in claim 2 wherein said first and second chutes are removably attached to said housing.

* * * * *